US009217620B2

(12) United States Patent
Peacemaker

(10) Patent No.: US 9,217,620 B2
(45) Date of Patent: Dec. 22, 2015

(54) STOCK ATTACHMENT RISER

(71) Applicant: Terrence L. W. Peacemaker, Chantilly, VA (US)

(72) Inventor: Terrence L. W. Peacemaker, Chantilly, VA (US)

( * ) Notice: Subject to any disclaimer, the term of this patent is extended or adjusted under 35 U.S.C. 154(b) by 0 days.

(21) Appl. No.: 13/950,594

(22) Filed: Jul. 25, 2013

(65) Prior Publication Data

US 2015/0027021 A1 Jan. 29, 2015

(51) Int. Cl.

| | |
|---|---|
| ***F41C 23/00*** | (2006.01) |
| ***F41C 23/08*** | (2006.01) |
| ***F41C 23/14*** | (2006.01) |
| ***F41C 23/20*** | (2006.01) |

(52) U.S. Cl.

CPC ..... *F41C 23/08* (2013.01); *F41C 23/14* (2013.01); *F41C 23/20* (2013.01)

(58) Field of Classification Search

CPC ..... F41C 23/00; F41C 23/06; F41C 23/09; F41C 23/14; F41C 23/20

USPC ..... 42/1.06, 71.01, 71.02, 72, 73, 74, 42/75.01, 75.03, 90, 106; D22/103, 108, D22/111

See application file for complete search history.

(56) References Cited

U.S. PATENT DOCUMENTS

| | | | | |
|---|---|---|---|---|
| 1,222,190 | A * | 4/1917 | Dimelow | 42/74 |
| 1,951,135 | A * | 3/1934 | Emswiler | 42/74 |
| 2,787,855 | A * | 4/1957 | Guymon | 42/73 |
| 3,875,694 | A * | 4/1975 | Wild | 42/73 |
| 4,887,374 | A * | 12/1989 | Santarossa | 42/73 |
| 5,974,718 | A * | 11/1999 | Bentley et al. | 42/74 |
| 7,337,573 | B1 * | 3/2008 | DiGiovanna | 42/71.01 |
| D643,498 | S * | 8/2011 | Burt | D22/111 |
| 8,087,193 | B2 * | 1/2012 | Kincel | 42/74 |
| D655,777 | S * | 3/2012 | Burt | D22/111 |
| 8,555,541 | B2 * | 10/2013 | Ingram | 42/71.01 |
| 2012/0174455 | A1 * | 7/2012 | Edelman et al. | 42/71.01 |
| 2012/0174456 | A1 * | 7/2012 | DePierro et al. | 42/71.01 |

OTHER PUBLICATIONS

Tactical Duostock. <http://milspecmonkey.com/index.php/weapons-page/stocks/132-tactical-duostock>. Mar. 30, 2009.*

Tactical Duostock. <http://web.archive.org/web/20101119085938/http://cqbradio.blogspot.com/2010/07/cqb-radio-episode-16-i-dont-have-name.html>. Nov. 19, 2010.*

Tactical Duostock. <http://www.ar15.com/mobile/topic.html?b=3&f=4&t=230097&page=80>. Apr. 21, 2008.*

Mini 14 Stock. <http://web.archive.org/web/20111109055746/http://ruger-mini-14-firearms.com/mini_14_30_accessories.php>. Nov. 9, 2011.*

* cited by examiner

*Primary Examiner* — Gabriel Klein

(74) *Attorney, Agent, or Firm* — Snyder, Clark, Lesch & Chung, LLP

(57) ABSTRACT

A weapon accessory includes an attachment portion that is attachable to a stock of a weapon. The weapon accessory includes a rest portion that allows a user to position the stock above the user's shoulder. The weapon accessory also includes a recoil portion that is configured to transfer a recoil to the user when the user uses the weapon.

12 Claims, 14 Drawing Sheets

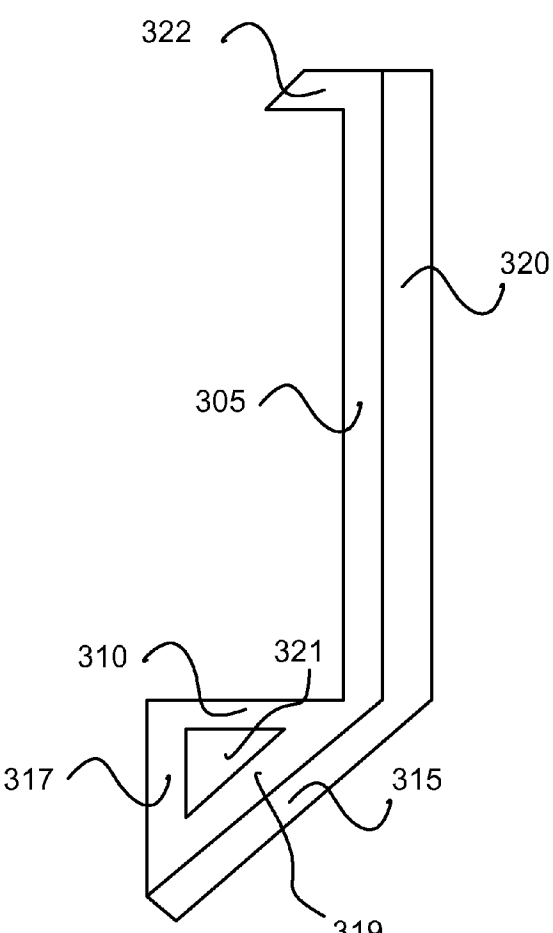
Fig. 3A
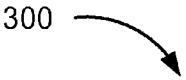

STOCK ATTACHMENT RISER

BACKGROUND

Users of weapons, such as rifles, position their bodies and heads when aiming and shooting the weapons. However, the physical attributes of users vary between individuals.

BRIEF DESCRIPTION OF THE DRAWINGS

FIG. 3A is a diagram illustrating a side view of yet another exemplary embodiment of a stock attachment riser;

DETAILED DESCRIPTION OF PREFERRED EMBODIMENTS

The following detailed description refers to the accompanying drawings. The same reference numbers in different drawings may identify the same or similar elements. Also, the following description does not limit the invention.

The physical attributes of users of weapons vary between individuals. In some instances, a user may position himself or herself in an uncomfortable position to aim and shoot due to their physical attributes. For example, the user may be very tall or may have a lengthy neckline that forces the user to lower his or her head in an uncomfortable position in order to see a weapon sight.

The term "weapon," as used herein is intended to include a device designed to inflict damage to a living thing, a non-living thing, or both. Alternatively, the weapon may be designed not to inflict damage. According to exemplary embodiments described herein, the weapon is intended to be operated by a person in a manner that requires the person to aim the weapon.

For purposes of description, the weapon includes a stock (also known as a buttstock or a shoulder stock). For example, the weapon may be implemented as a firearm, such as a rifle that includes a stock. The weapon may fire, propel, emit, etc., various types of objects or things, such as an arrow, a bullet, a rocket, an explosive, a laser, fire, a magnetic field, a biological agent, a chemical agent, a paint ball, etc. Alternatively, the weapon may fire, propel, emit, etc., various types of objects that do not cause damage, such as a foam ball, etc.

According to an exemplary embodiment, a stock riser is attachable to and detachable from a stock or similar element of a weapon. According to an exemplary embodiment, the stock riser creates a higher placement position of the weapon on the user (e.g., the user's shoulder). In this way, the user is able to aim the weapon with minimal or no discomfort. For example, the user may not need to lower his or her head in an uncomfortable position in order to aim using the firearm sights. Stated differently, the user may be able to keep their head in a more upright position, which may reduce the onset of fatigue and allow the user to aim more accurately.

Figure 1A:
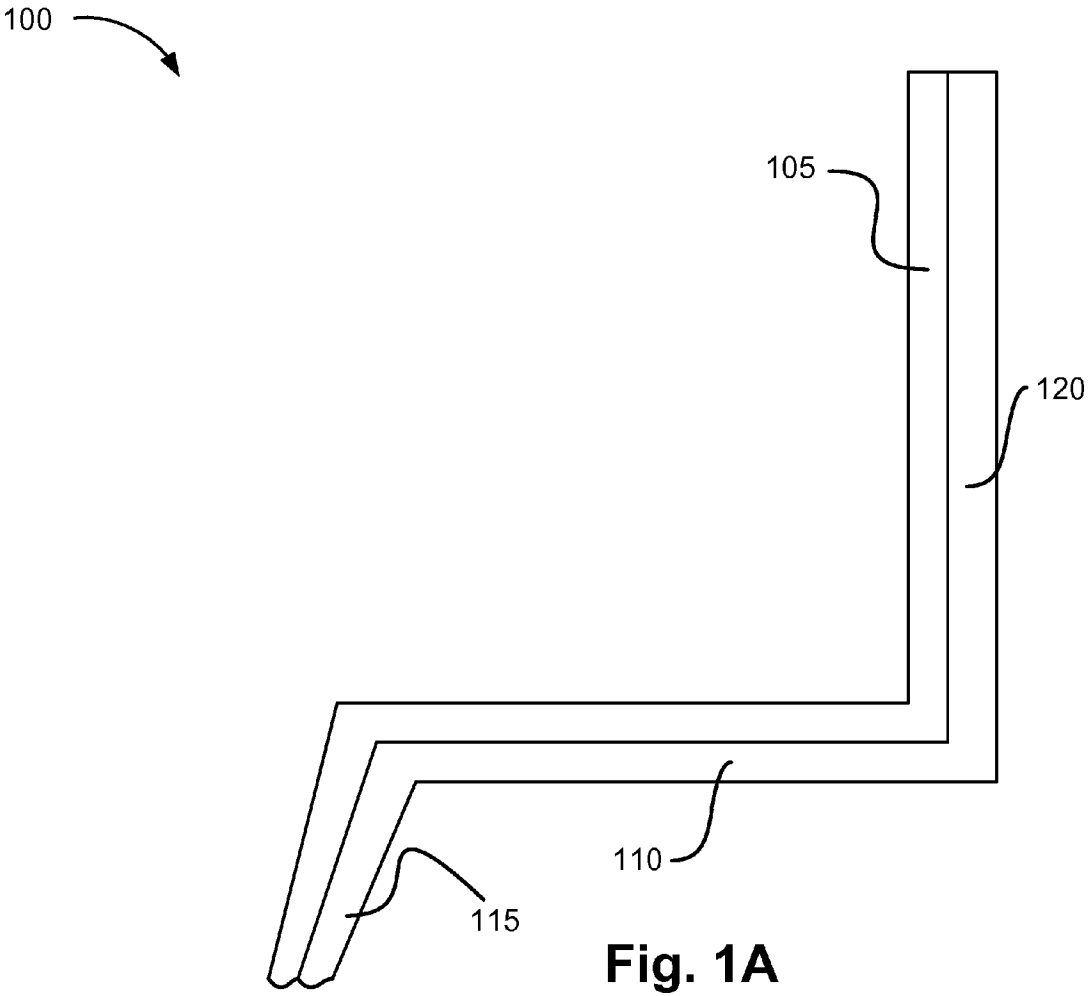
FIG. 1A is a diagram illustrating a side view of an exemplary embodiment of a stock attachment riser.

FIG. 1A is a diagram illustrating a side view of an exemplary embodiment of a stock attachment riser. As illustrated, a stock attachment riser 100 includes an attachment portion 105, a rest portion 110, a recoil portion 115, and an end portion 120. Although stock attachment riser 100 is illustrated as an integrated multi-portion apparatus, according to other embodiments, stock attachment riser 100 may be formed as a unitary apparatus.

Stock attachment riser 100 may be made from various materials. For example, stock attachment riser 100 may be made from plastic, wood, metal, or some suitable composite. By way of further example, stock attachment riser 100 or a portion of stock attachment riser 100 may be made from a thermoplastic, fiberglass, Kevlar, aluminum, or lighter-than-steel alloy. Additionally, for example, a portion of stock attachment riser 100 may be made from a rubber-like material. For example, rest portion 110, recoil portion 115, and/or end portion 120 may be made from a rubber-like material, foam, or other suitable flexible material. Additionally, for example, a portion of stock attachment riser 100 may include a texture. For example, the texture may reduce slippage, improve grip, etc., pertaining to the user. Stock attachment riser 100 may be made from a material that takes into account weight, balance, and uniformity considerations with respect to the weapon.

Attachment portion 105 is a portion of stock attachment riser 100 that attaches to the stock of the weapon. Although not illustrated, according to an exemplary implementation, attachment portion 105 and end portion 120 may include holes to allow screws or other types of fasteners to secure stock attachment riser 100 to the stock of the weapon. According to other implementations, attachment portion 105 may include securing mechanisms. For example, attachment portion 105 may include clips, levers, extensions, adjustable clamps, or other retention devices to allow stock attachment riser 100 to secure itself to the stock of the weapon.

As illustrated in subsequent figures, attachment portion 105 has a size and shape that conforms to the size and shape of the stock of the weapon. In this regard, attachment portion 105 of stock attachment riser 100 may be designed toward fitting standard or customized stocks.

Rest portion 110 is a portion of stock attachment riser 100 that rests on the user's shoulder when aiming the weapon. Although FIG. 1A illustrates rest portion 105 as planar, according to other implementations, rest portion 105 may be curved or contoured to comfortably rest on the user's shoulder. According to an exemplary implementation, rest portion 105 extends substantially perpendicular from attachment portion 105. Additionally, as previously described, rest portion 110 may be made from a material suitable for recoil absorption.

Recoil portion 115 is a portion of stock attachment riser 100 that rests on the front shoulder of the user. In this way, when a weapon is fired, recoil portion 115 transfers any concomitant recoil towards the user's shoulder area. According to an exemplary implementation, recoil portion 115 may extend near the chest area of the user (e.g., top portion of the chest, mid-chest area, etc.).

End portion 120 is an end portion of stock attachment riser 100. According to an exemplary use case, the user may use end portion 120 as a standard end portion of the stock of the weapon. According to such a use case, end portion 120 may be positioned in the shoulder area of the user. In this way, end portion 120 may transfer recoil to the user's shoulder area. According to another exemplary use case, when the user has rest portion 110 on his or her shoulder, end portion 120 may be above the user's shoulder.

Figure 1B:
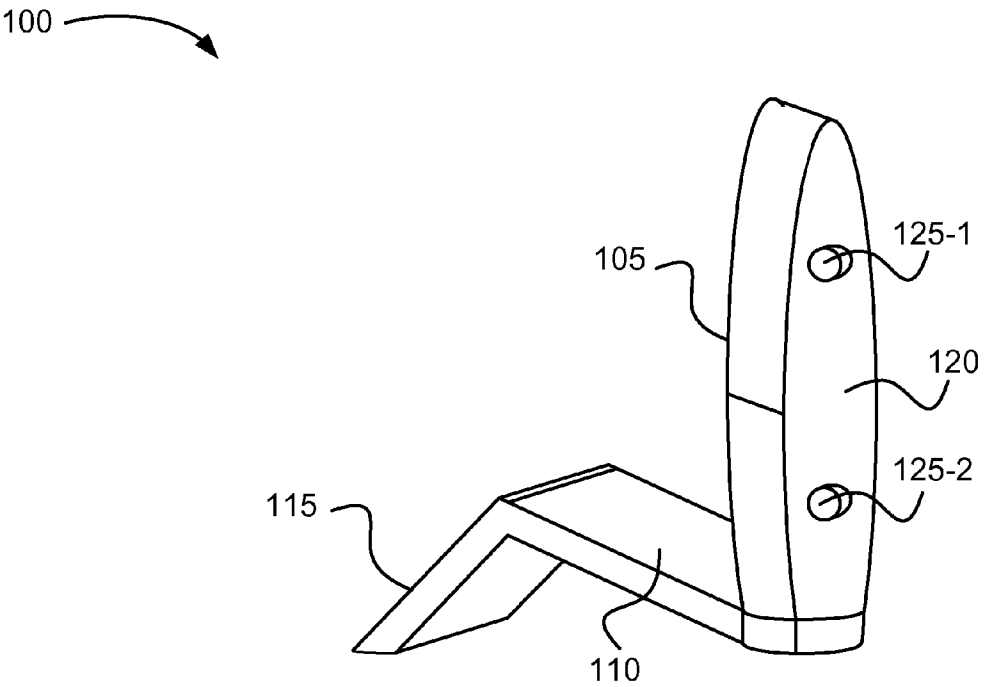
FIG. 1B is a diagram illustrating a back-side, isometric view of the stock attachment riser.

FIG. 1B is a diagram illustrating a back-side, isometric view of stock attachment riser 100. As illustrated, attachment portion 105 and end portion 120 have suitable dimensions (e.g., in terms of size, shape, etc.) to conform to the stock of the weapon. Additionally, as illustrated, according to an exemplary implementation, attachment portion 105 includes holes 125-1 and 125-2 (also referred to as holes 125). Holes 125 may include female threading. A user may attach stock attachment riser 100 to the stock of the weapon using holes 125 and, for example, screws. However, as previously explained, according to other implementations, other mechanisms may be used to allow attachment portion 105 to be attachable to and detachable from the stock of the weapon.

Figure 1C:
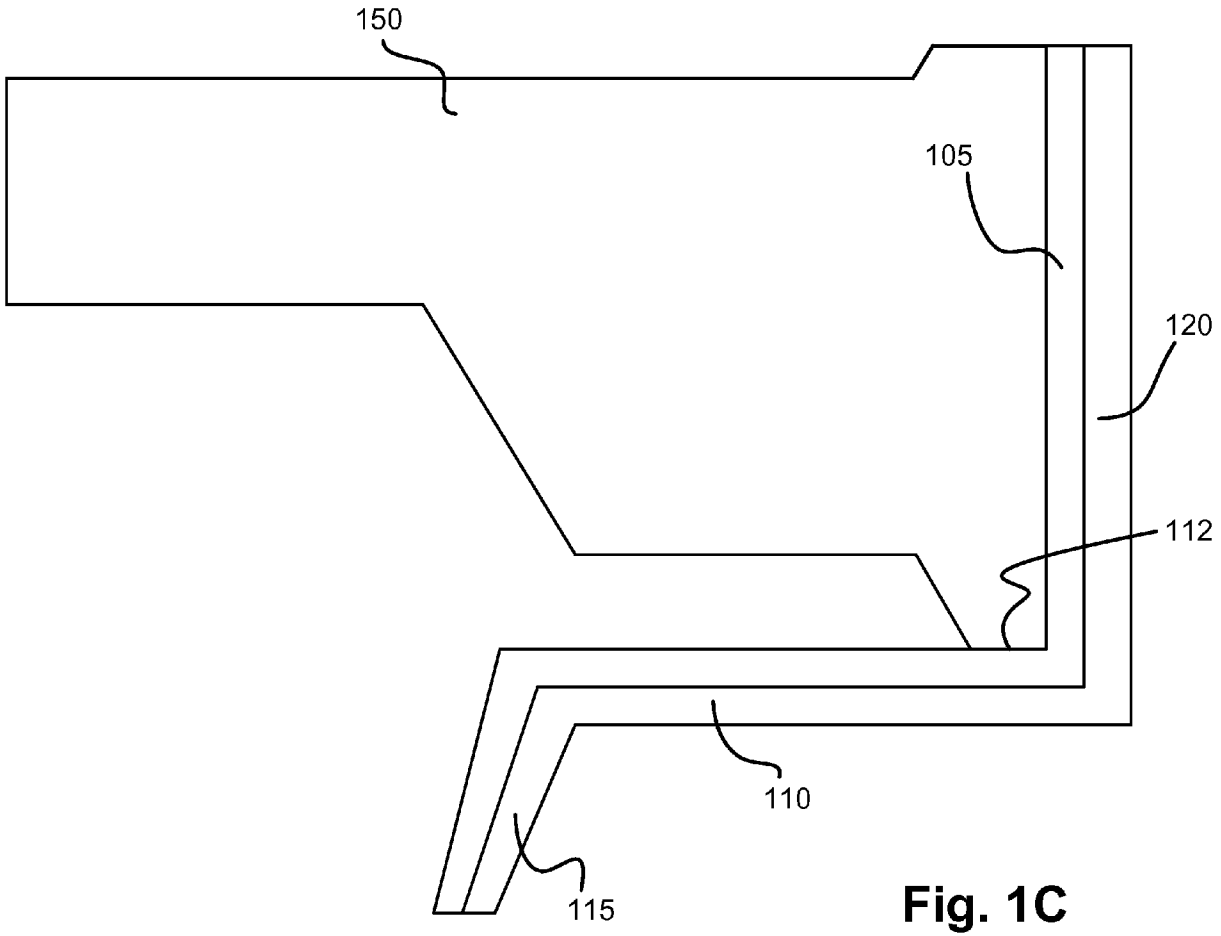
FIG. 1C is a diagram illustrating a side view of the stock attachment riser attached to an exemplary stock of a weapon.

FIG. 1C is a diagram illustrating a side view of stock attachment riser 100 attached to an exemplary stock of a weapon. As illustrated, a stock 150 of the weapon is attached to attachment portion 105. A portion of stock 150 may make contact with a top surface 112 of rest portion 110.

Figure 2A:
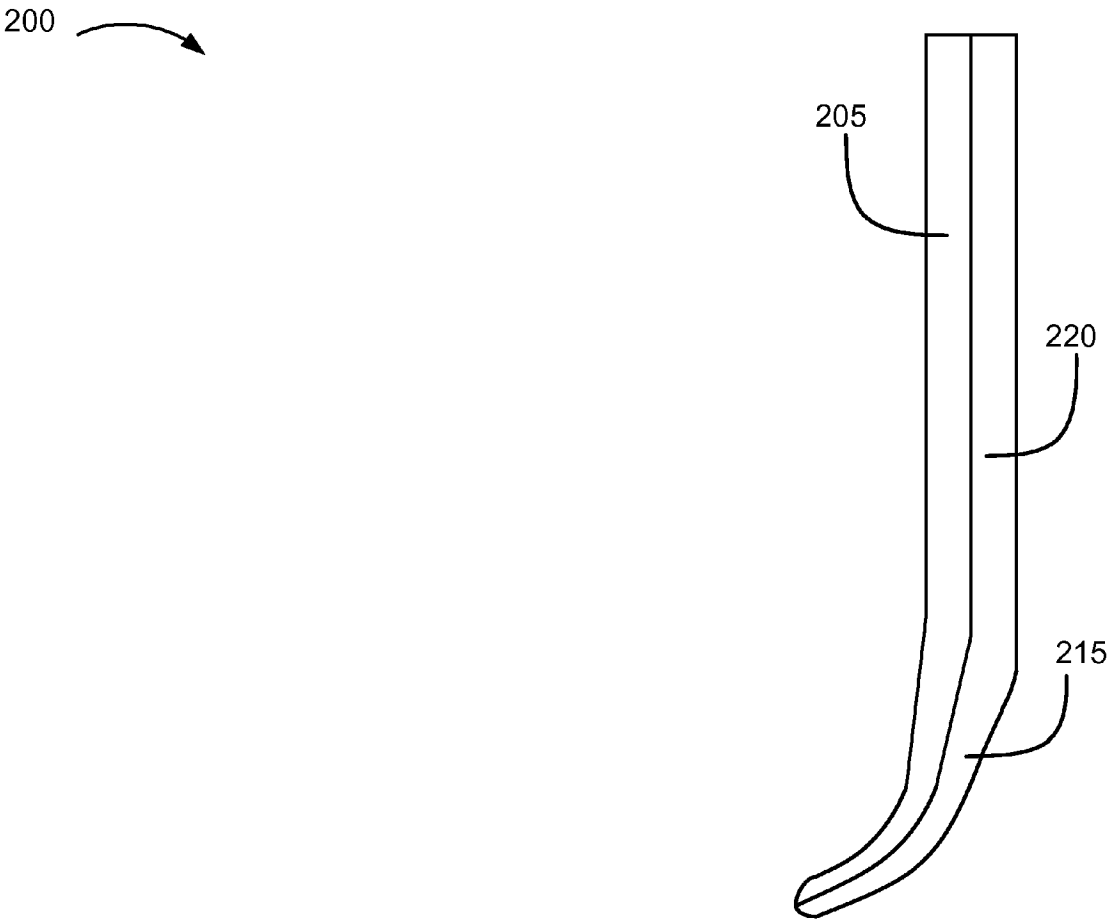
FIG. 2A is a diagram illustrating a side view of another exemplary embodiment of a stock attachment riser.

FIG. 2A is a diagram illustrating a side view of another exemplary embodiment of a stock attachment riser. As illustrated, a stock attachment riser 200 includes an attachment portion 205, a recoil portion 215, and an end portion 220.

Figure 2B:
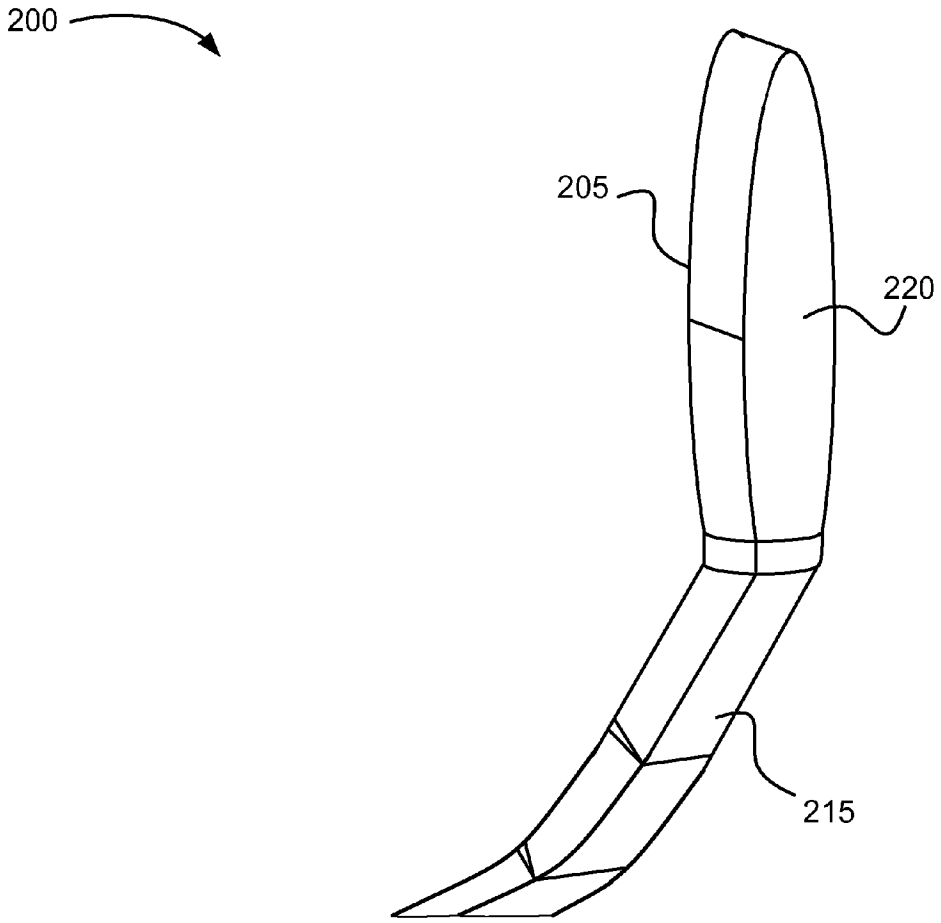
FIG. 2B is a diagram illustrating a back-side, isometric view of the stock attachment riser.
Figure 2C:
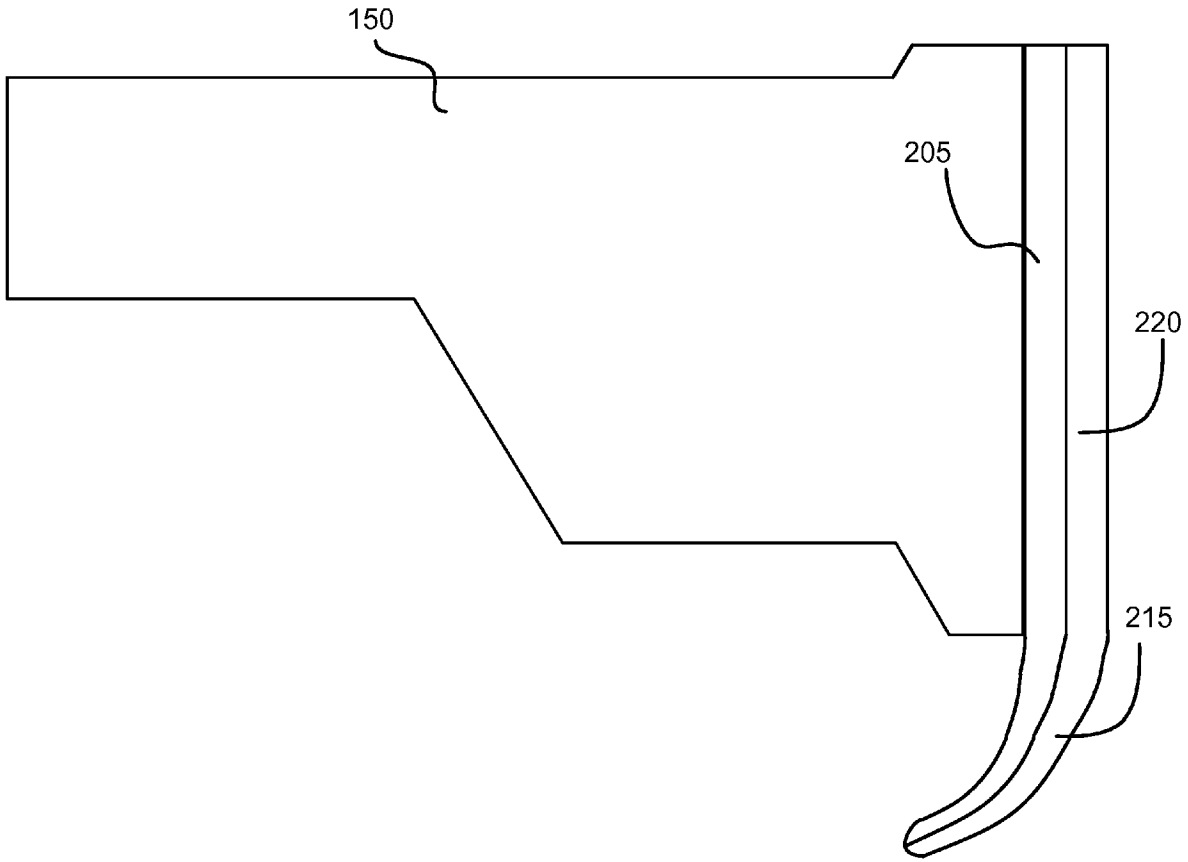
FIG. 2C is a diagram illustrating a side view of the stock attachment riser attached to an exemplary stock of a weapon.

Attachment portion 205 and end portion 220 may provide similar functionality as previously explained above in relation to attachment portion 105 and end portion 120. However, according this embodiment, recoil portion 215 extends from attachment portion 205 and end portion 220. As illustrated, recoil portion 215 includes a curved contour to allow the user to place recoil portion 215 in the shoulder area when aiming the weapon. Recoil portion 215 may transfer recoil to the user's shoulder area. FIG. 2B is a diagram illustrating a back-side, isometric view of stock attachment riser 200. FIG. 2C is a diagram illustrating a side view of the stock attachment riser attached to an exemplary stock 150 of a weapon.

FIG. 3A is a diagram illustrating a side view of yet another exemplary embodiment of a stock attachment riser. As illustrated, a stock attachment riser 300 includes an attachment portion 305, a support portion 310, a recoil portion 315, a support portion 317, a support portion 319, an end portion 320, and a top rest portion 322. Attachment portion 305 and end portion 320 may provide similar functionality as previously explained above in relation to attachment portion 105 and end portion 120.

Recoil portion 315 is a portion of stock attachment riser 300 that rests on the front shoulder of the user. In this way, when a weapon is fired, recoil portion 315 transfers any concomitant recoil towards the user's shoulder area.

Support portions 310, 317, and 319 are portions of stock attachment riser 300 that strengthens and supports recoil portion 315. As illustrated, support portions 310, 317, and 319 may form a space 321. Top rest portion 322 is a portion of stock attachment riser 300 is configured to meet a top portion of a stock of a weapon. According to an exemplary implementation, support portion 317 extends substantially perpendicular to support portion 310 and substantially parallel to attachment portion 305. Additionally, according to an exemplary implementation, top rest portion 322 extends substantially parallel to support portion 310.

Figure 3B:
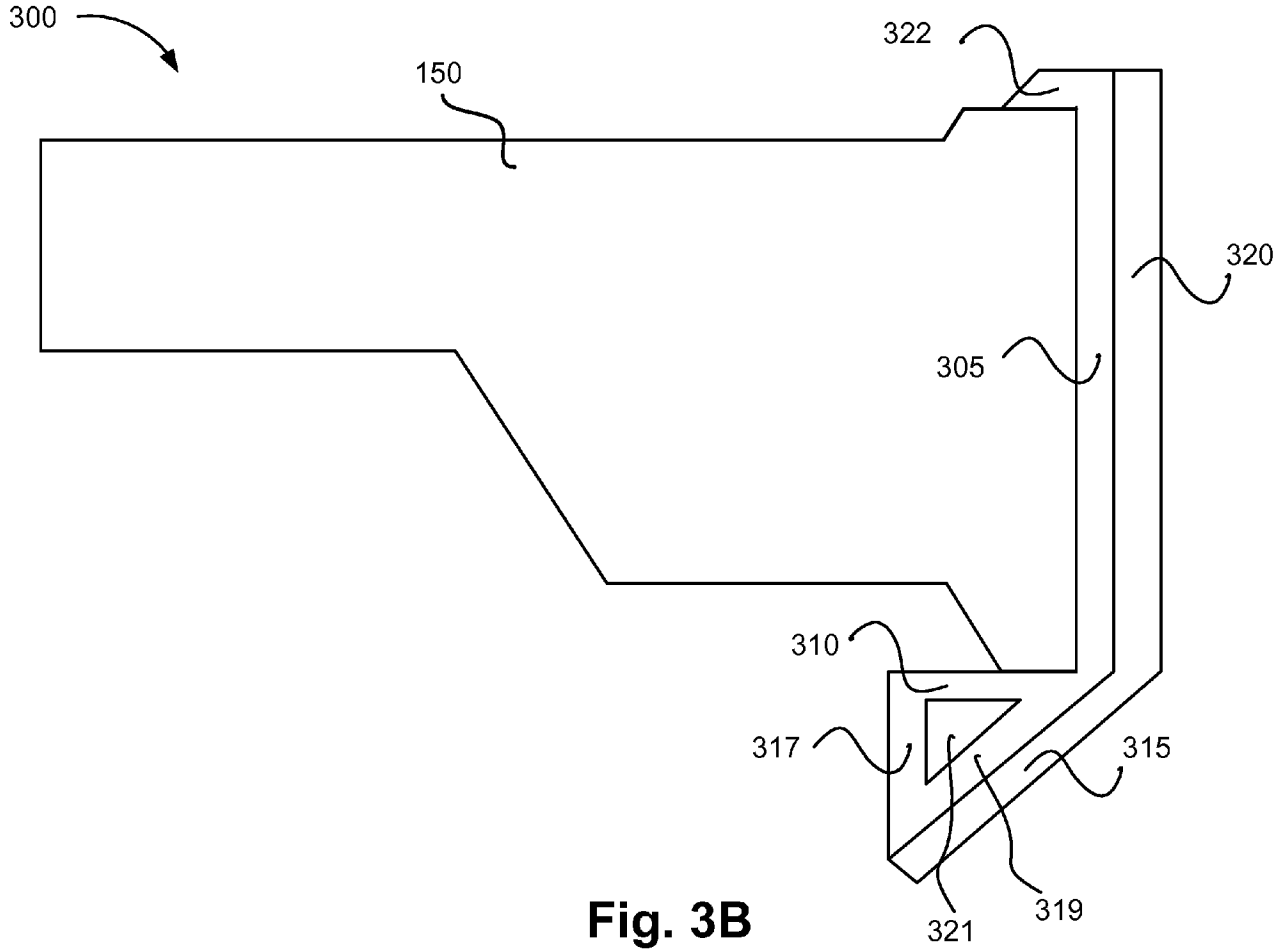
FIG. 3B is a diagram illustrating a side view of the stock attachment riser attached to an exemplary stock of a weapon.

FIG. 3B is a diagram illustrating a side view of stock attachment riser 300 attached to an exemplary stock 150 of a weapon. As illustrated, top rest portion 322, attachment portion 305, and support portion 310 creates a recess to receive stock 150 of the weapon. Additionally, support portion 310 may make contact with a bottom portion stock 150.

Figure 3C:
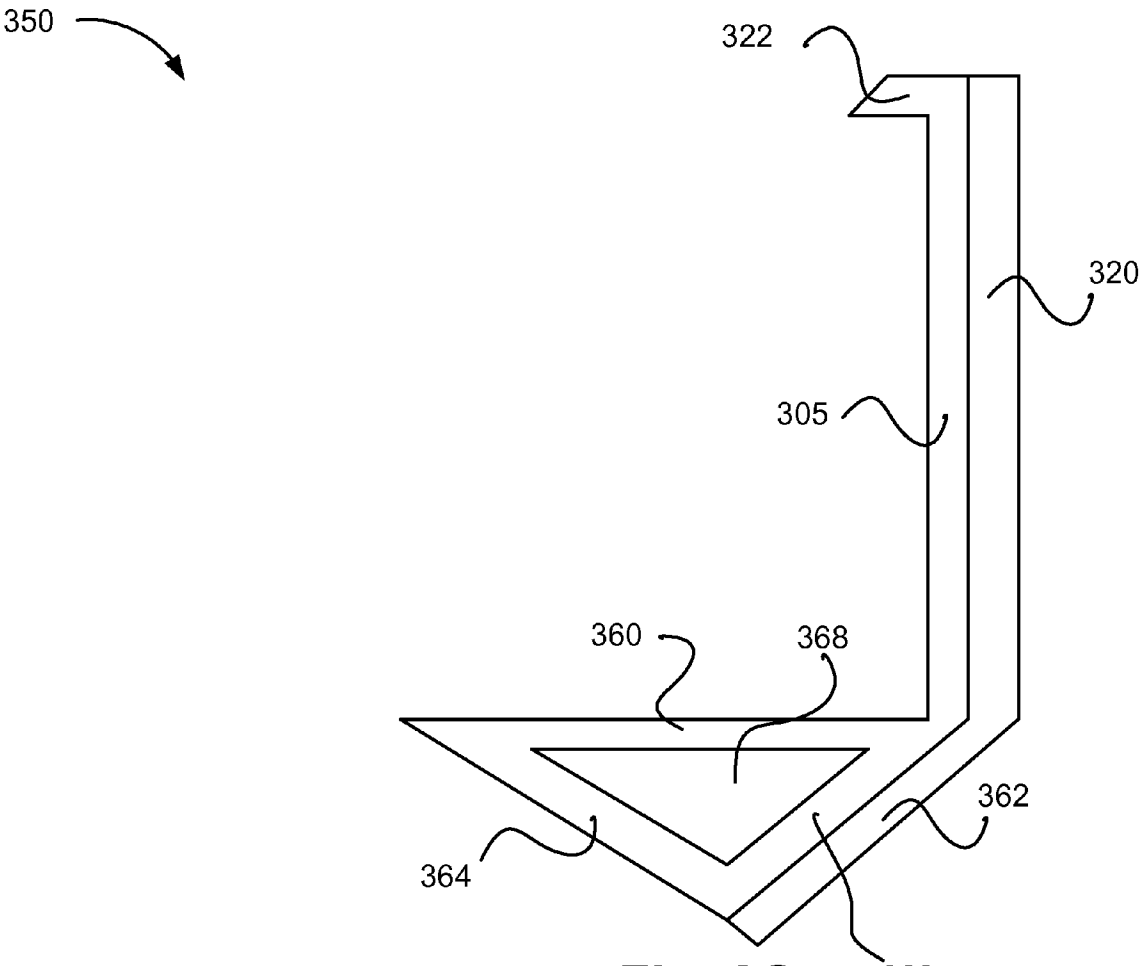
FIG. 3C is a diagram illustrating a side view of still another exemplary embodiment of a stock attachment riser.

FIG. 3C is a diagram illustrating a side view of still another exemplary embodiment of a stock attachment riser. As illustrated, a stock attachment riser 350 includes attachment portion 305, end portion 320, top rest portion 322, a support portion 360, a recoil portion 362, a support portion 364, and a support portion 366. Attachment portion 305, end portion 320, and top rest portion 322 may provide similar functionality as previously explained above in relation to attachment portion 105, end portion 120, and top rest portion 322 of FIG. 3A. Also, support portions 360, 364, and 366 may provide similar functionality as previously explained above in relation to support portions 310, 317, and 319. Support portions 360, 364, and 366 define a space 368. In contrast to support portion 310 of stock attachment riser 300, support portion 360 extends further outward from attachment portion 305. This configuration may provide additional surface area contact with stock 150 of the weapon. Additionally, in contrast to support portion 317, which is substantially perpendicular to support portion 310, support portion 364 may be angled differently.

Figure 4A:
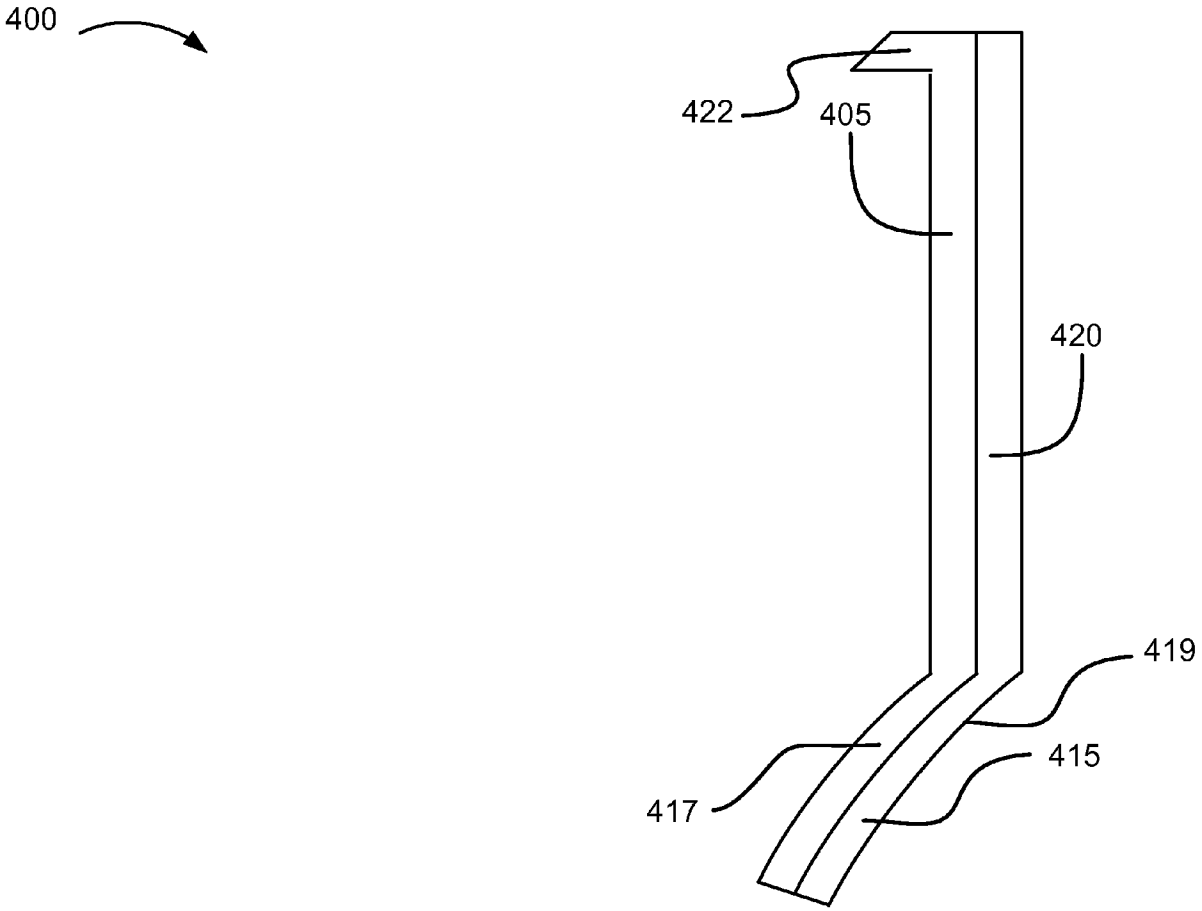
FIG. 4A is a diagram illustrating a side view of an exemplary embodiment of a stock attachment riser.
Figure 4B:
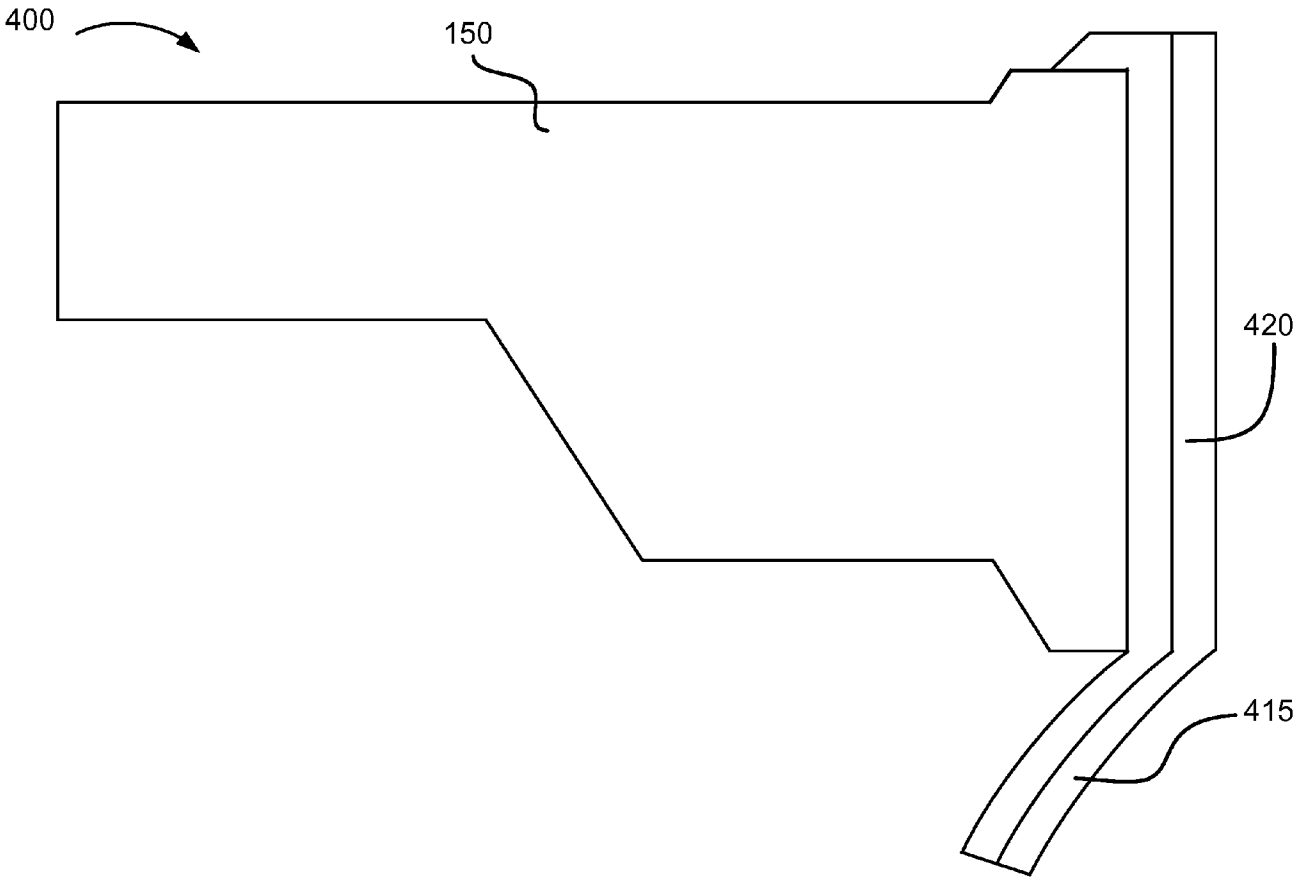
FIG. 4B is a diagram illustrating a side view of the stock attachment riser attached to an exemplary stock of a weapon.

FIG. 4A is a diagram illustrating a side view of an exemplary embodiment of a stock attachment riser. As illustrated, a stock attachment riser 400 includes an attachment portion 405, a recoil portion 415, a recoil support portion 417, an end portion 420, and a top rest portion 422. Attachment portion 405, end portion 420, and top rest portion 422 may provide similar functionality as previously explained above in relation to attachment portion 105, end portion 120, and top rest portion 322 of FIG. 3A. Additionally, recoil portion 415 provides a similar functionality as recoil portion 215. However, as illustrated in FIG. 4A, recoil portion 415 has a curvature opposite to the curvature of recoil portion 215. That is, recoil portion 415 may have a concave-like surface 419 versus a convex-like surface of recoil portion 215. Recoil portion 415 may have a contour that follows the upper shoulder area towards the chest area of a user. Recoil support portion 417 strengthens and supports recoil portion 415. FIG. 4B is a diagram illustrating a side view of stock attachment riser 400 attached to an exemplary stock 150 of a weapon.

Figure 5A:
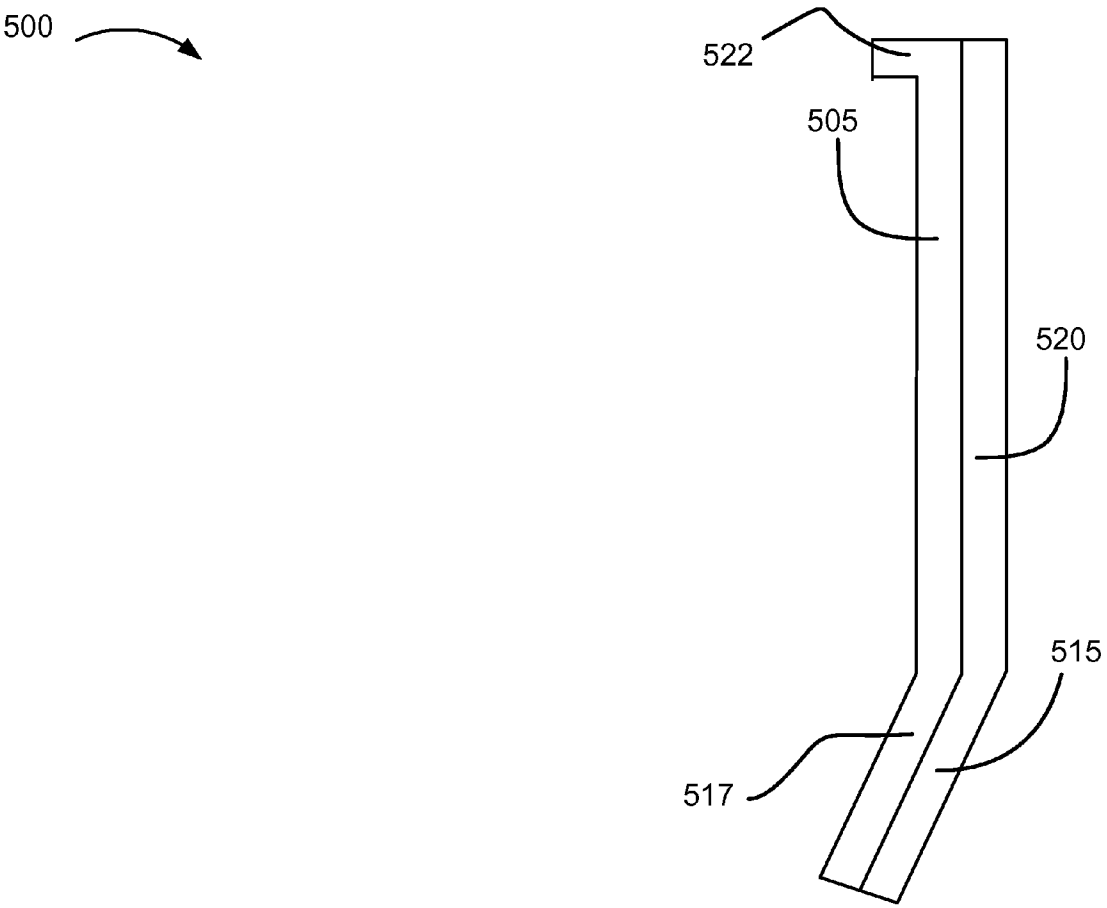
FIG. 5A is a diagram illustrating a side view of another exemplary embodiment of a stock attachment riser.
Figure 5B:
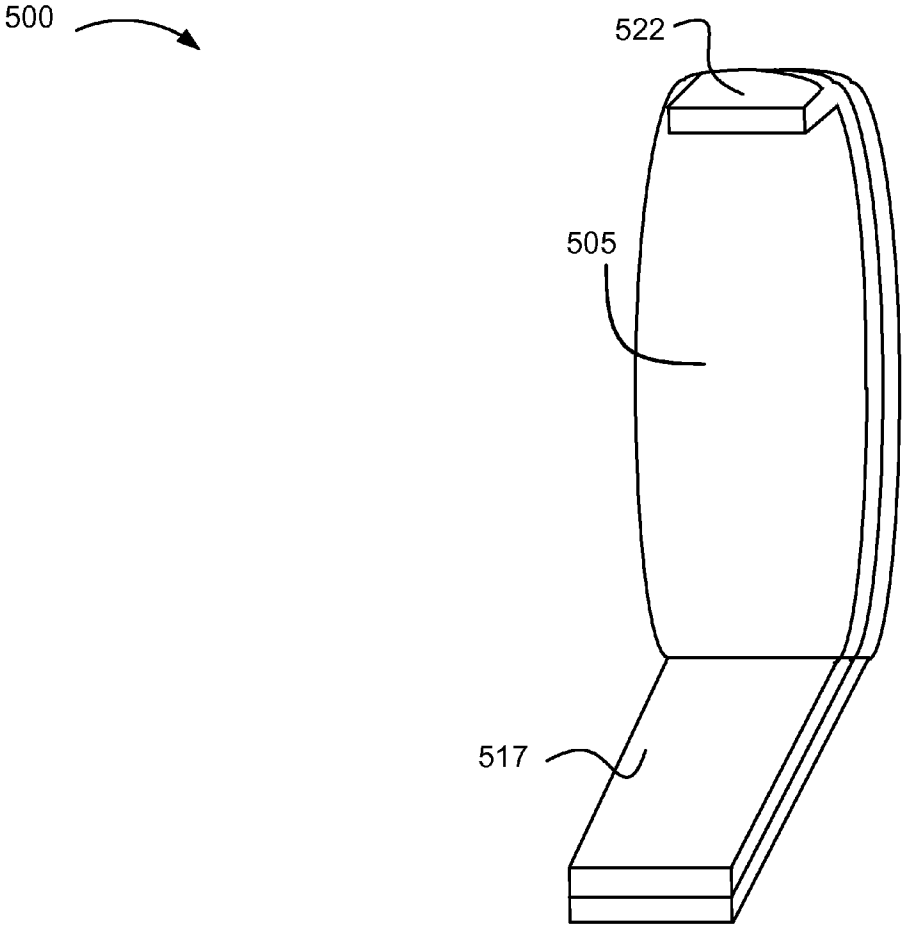
FIG. 5B is a diagram illustrating a front-side, isometric view of the stock attachment riser.

FIG. 5A is a diagram illustrating a side view of another exemplary embodiment of a stock attachment riser. As illustrated, a stock attachment riser 500 includes an attachment portion 505, a recoil portion 515, a recoil support portion 517, an end portion 520, and a top rest portion 522. Attachment portion 505, end portion 520, and top rest portion 522 may provide similar functionality as previously explained above in relation to attachment portion 105, end portion 120, and top rest portion 322 of FIG. 3A. Additionally, recoil portion 515 provides a similar functionality as recoil portion 215. However, as illustrated in FIG. 5A, recoil portion 515 has a linear or planar configuration in contrast to recoil portions 215 and 415. Recoil support portion 517 strengthens and supports recoil portion 515. FIG. 5B is a diagram illustrating a front-side, isometric view of stock attachment riser 500.

Figure 6:
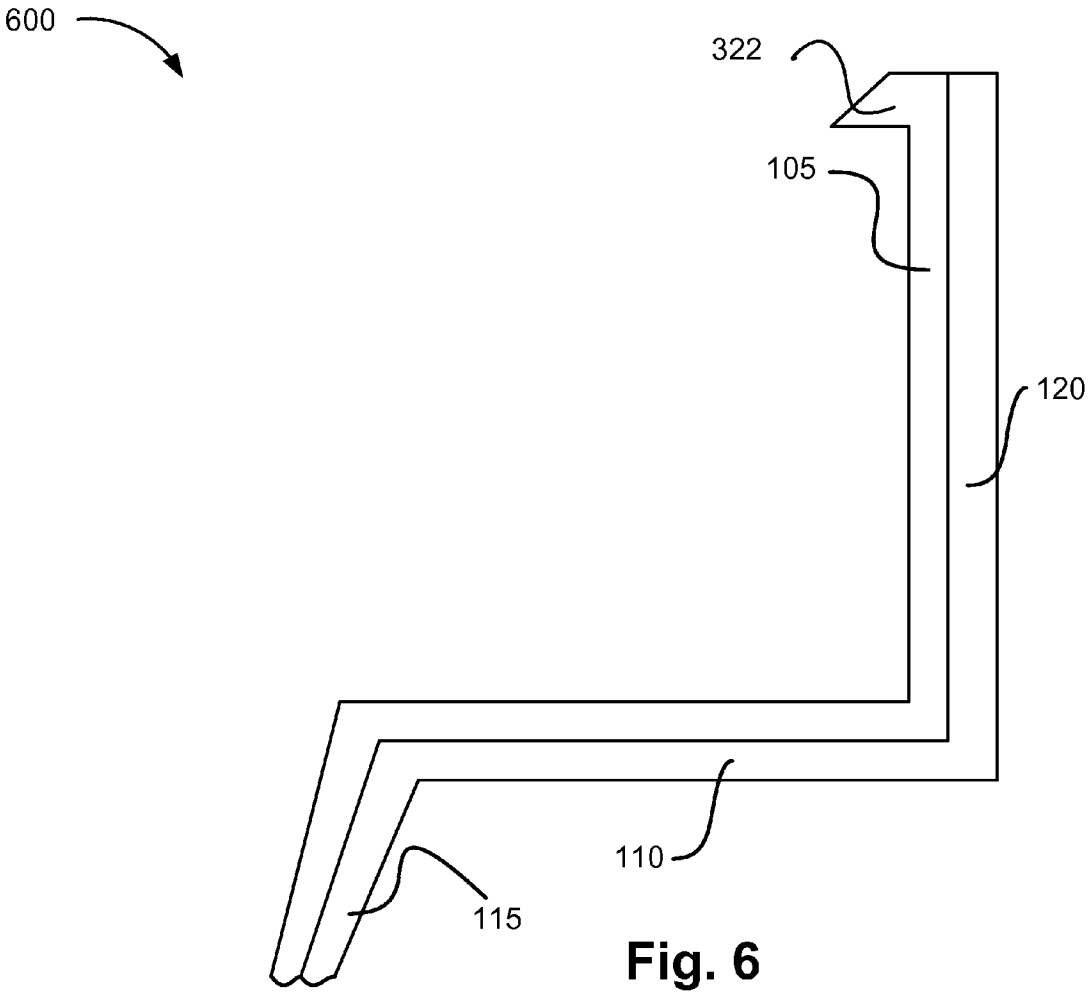
FIG. 6 is a diagram illustrating a side view of still another exemplary embodiment of a stock attachment riser.

FIG. 6 is a diagram illustrating a side view of still another exemplary embodiment of a stock attachment riser. As illustrated, a stock attachment riser 600 is similar to stock attachment riser 100. However, stock attachment riser 600 includes top rest portion 322. As illustrated, top rest portion 322 extends substantially parallel to rest portion 110.

The foregoing description of embodiments provides illustration, but is not intended to be exhaustive or to limit the embodiments to the precise form disclosed. In this regard, the concepts described herein may have broader application.

The terms "a," "an," and "the" are intended to be interpreted to include one or more items. Further, the phrase "based on" is intended to be interpreted as "based, at least in part, on," unless explicitly stated otherwise. The term "and/or" is intended to be interpreted to include any and all combinations of one or more of the associated items.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

In the preceding specification, various embodiments have been described with reference to the accompanying drawings. It will, however, be evident that various modifications and changes may be made thereto, and additional embodiments may be implemented, without departing from the broader scope of the invention as set forth in the claims that follow. For example, various changes to form, design, shape, contour, number of, and/or arrangement may be made to an embodiment without departing from the spirit and scope of the invention. Therefore, the above-mentioned description is to be considered exemplary, rather than limiting, and the true scope of the invention is that defined in the following claims. The specification and drawings are accordingly to be regarded as illustrative rather than restrictive.

In the specification and illustrated by the drawings, reference is made to "an exemplary embodiment," "an embodiment," "embodiments," etc., which may include a particular feature, structure or characteristic in connection with an embodiment(s). However, the use of the phrase or term "an embodiment," "embodiments," etc., in various places in the specification does not necessarily refer to all embodiments described, nor does it necessarily refer to the same embodiment, nor are separate or alternative embodiments necessarily mutually exclusive of other embodiment(s). The same applies to the term "implementation," "implementations," etc.

No element described in the description should be construed as critical or essential to the embodiments described herein unless explicitly described as such.

What is claimed is:

1. An apparatus comprising:

an attachment portion, wherein the attachment portion is attachable to and detachable from a stock of a weapon;

a recoil portion, wherein the recoil portion is connected to the attachment portion, and the recoil portion is configured to transfer a recoil, resulting from use of the weapon, to a user;

a first support portion, wherein a first end of the first support portion connects to the attachment portion and provides support for the recoil portion;

a second support portion, wherein the second support portion extends from a second end of the first support portion to the recoil portion, wherein the second support portion extends perpendicular to the first support portion and parallel to the attachment portion; and a third support portion, wherein the third support portion extends from the first end of the first support portion to the second support portion, and wherein a space is defined by the first support portion, the second support portion, and the third support portion.

2. The apparatus of claim 1, wherein the recoil portion is integrally formed with the attachment portion at an end of the attachment portion, and the recoil portion extends at angle from the end of the attachment portion.

3. The apparatus of claim 1, wherein the recoil portion comprises a flexible material.

4. The apparatus of claim 1, further comprising:

a hat portion, wherein the hat portion extends parallel to the first support portion, wherein the hat portion is located at a first end of the attachment portion and the first support portion is located at a second end of the attachment portion, wherein the first end and the second end are opposite ends of the attachment portion.

5. The apparatus of claim 4, wherein the hat portion and the first support portion are configured to make contact with the stock when the apparatus is attached to the stock.

6. The apparatus of claim 1, wherein the apparatus comprises at least one of plastic, metal, wood, or a composite.

7. The apparatus of claim 1, wherein the attachment portion includes one or more holes configured to receive fasteners, and wherein the one or more holes extend parallel to the first support portion.

8. An accessory of a weapon, comprising:

an attachment portion, wherein the attachment portion is configured to attach to and detach from a butt portion of a stock of a weapon;

a recoil portion, wherein the recoil portion extends from a first end of the attachment portion, and the recoil portion is configured to transfer a recoil, resulting from use of the weapon, to a user;

a first support portion, wherein a first end of the first support portion is integrally formed with the first end of the attachment portion and the first end of the recoil portion, and the first support portion provides support for the recoil portion, and the first support portion extends perpendicular to the attachment portion;

a second support portion, wherein a first end of the second support portion extends from a second end of the first support portion to a second end of the recoil portion, wherein the second support portion extends perpendicular from the first support portion and parallel to the attachment portion; and a third support portion, wherein a first end of the third support portion is integrally formed with the first ends of the attachment portion, the recoil portion, and the first support portion, and wherein the third support portion extends to a second of the third support portion, wherein the second end of the third support portion is integrally formed with the second ends of the recoil portion and the second support portion, wherein a first end of the recoil portion is integrally formed with the attachment portion at the first end of the attachment portion, and the recoil portion extends at angle from the first end of the attachment portion, and wherein the recoil portion is planar.

9. The accessory of claim 8, further comprising:

a hat portion, wherein the hat portion extends perpendicular from a second end of the attachment portion, and wherein the hat portion is configured to make contact with the stock when the stock is attached, wherein the second end and the first end of the attachment portion are opposite ends.

10. The accessory of claim 8, wherein the attachment portion includes one or more holes configured to receive fasteners, and wherein the one or more holes extend parallel to the first support portion.

11. The accessory of claim 8, wherein the accessory comprises at least one of plastic, metal, wood, or a composite.

12. The accessory of claim 8, wherein the recoil portion comprises a flexible material.

* * * * *